US005109613A

United States Patent [19]

Van Dyke

[11] Patent Number: 5,109,613

[45] Date of Patent: May 5, 1992

[54] SHOE WITH INTEGRAL ANKLE SUPPORT

[75] Inventor: Mark W. Van Dyke, Erie, Pa.

[73] Assignee: Ronin, Inc., St. Louis, Mo.

[21] Appl. No.: 630,450

[22] Filed: Dec. 20, 1990

Related U.S. Application Data

[63] Continuation of Ser. No. 369,267, Jun. 21, 1989, abandoned.

[51] Int. Cl.[5] ..... A43B 7/20

[52] U.S. Cl. ..... 36/89; 36/114

[58] Field of Search ..... 36/89, 90, 107, 114, 36/132, 69; 128/80 H

[56] References Cited

U.S. PATENT DOCUMENTS

| | | | |
|---|---|---|---|
| 746,338 | 12/1903 | Keen . | |
| 765,024 | 7/1904 | Lueck | 36/90 |
| 912,862 | 2/1909 | Lendgren | 36/69 |
| 1,549,382 | 8/1925 | Riddell | 36/89 |
| 1,692,896 | 11/1928 | Hilgert | 36/107 X |
| 2,444,428 | 8/1945 | Carrier | 36/8.5 |
| 2,634,515 | 8/1951 | Saitta | 36/8.5 |
| 2,918,734 | 11/1958 | Hyde | 36/8.5 |
| 2,972,822 | 9/1959 | Tanner | 36/8.5 |
| 3,064,644 | 11/1962 | Patterson | 128/80 H |
| 3,298,365 | 12/1963 | Lewis | 128/80 |
| 3,537,716 | 11/1970 | Nargiel | 36/89 X |
| 3,613,273 | 3/1970 | Marquis | 36/2.5 N |
| 3,674,023 | 7/1972 | Mann | 128/166 |
| 3,948,253 | 4/1976 | Burke | 128/80 J |
| 4,280,489 | 7/1981 | Johnson, Jr. | 128/80 H |
| 4,402,146 | 9/1983 | Parracho et al. | 36/69 X |
| 4,433,682 | 2/1984 | Badra | 128/153 |
| 4,440,158 | 4/1984 | Shapiro | 128/80 H |
| 4,510,701 | 4/1985 | Schour et al. | 36/69 X |
| 4,510,927 | 4/1985 | Peters | 128/80 H |
| 4,517,968 | 5/1985 | Greene et al. | 128/80 H |
| 4,523,394 | 6/1985 | Lindh et al. | 36/89 |
| 4,546,555 | 10/1985 | Spademan | 36/28 |
| 4,554,912 | 11/1985 | Haberman | 128/80 E |
| 4,590,932 | 5/1986 | Wilkerson | 128/166 |
| 4,628,945 | 12/1986 | Johnson, Jr. | 128/80 H |
| 4,630,600 | 12/1986 | Spencer et al. | 128/80 R |
| 4,676,011 | 6/1987 | O'Rourke et al. | 36/89 |
| 4,719,926 | 1/1988 | Nelson | 128/80 H |
| 4,727,863 | 3/1988 | Nelson | 128/80 H |
| 4,766,681 | 8/1988 | O'Rourke et al. | 36/89 |
| 4,776,111 | 10/1988 | Crowley | 36/89 |
| 4,809,686 | 3/1989 | Crane | 36/89 X |
| 4,922,630 | 5/1990 | Robinson | 36/90 X |
| 4,947,560 | 8/1990 | Fuerst et al. | 36/114 X |
| 4,989,350 | 2/1991 | Bunch et al. | 36/89 |

FOREIGN PATENT DOCUMENTS

| | | |
|---|---|---|
| 8704354 | 7/1988 | Fed. Rep. of Germany . |
| 8704102 | 9/1988 | Fed. Rep. of Germany . |
| 57343 | 3/1984 | Taiwan . |

*Primary Examiner*—Paul T. Sewell
*Assistant Examiner*—Ted Kavanaugh
*Attorney, Agent, or Firm*—Heller & Kepler

[57] ABSTRACT

A shoe with an integral ankle support preferably for, but not limited to, an athletic shoe, has a plurality of adjustable straps and brace members attached to a shoe upper. The brace members provide semi-rigid support and are attached medially and laterally to the upper inner surface with a rivet in each brace member, thereby allowing movement of the brace members in an anterior and posterior direction about an axis defined by the rivets.

18 Claims, 2 Drawing Sheets

SHOE WITH INTEGRAL ANKLE SUPPORT

This is a continuation of copending application Ser. No. 07/369,267 filed on Jun. 21, 1981, now abandoned.

BACKGROUND OF THE INVENTION

The present invention relates to a shoe providing an integral ankle support and pertains, more particularly, to an athletic or activity shoe providing ankle support and protection for a wearer's talofibular and talotibial joints from external and internal rotation. The shoe of this invention is an improvement over the conventional ankle tape, elastic tape, and ankle braces.

An ankle joint consists of three bones (the tibia fibula, and talus) united by several ligamentous structure, the bone and ligament combination providing ankle joint motion in three planes while still providing a relatively stable joint. A weakness inherent in the motion of the ankle joint stems from the capability of the ankle joint to move in any of the three planes.

Ankle sprains are the most frequent injury to the lower extremity below the knee. A major cause of ankle injuries relates to movement of the talofibular and talotibial joint, more particularly, an internal and external rotation about these joints. It is proposed that an ankle sprain could be caused as a result of a lower portion of a foot remaining stationary and the tibia and fibula sustaining a forced rotation in either an internal or an external fashion causing ligaments about the ankle joint to tear.

With the conventional ankle supporting methods and devices it is generally viewed necessary to protect against ankle injury by supporting and protecting the ankle and in particualr to restrict ankle joint motion in any unintended direction. This is the general accepted purpose behind the practice of taping ankles, wrapping ankles in elastic tape, or providing some form of an ankle brace to be worn alone or in conjunction with a shoe. These conventional ankle braces are typically constructed using rigid shell-like or support members attached to a shoe outer surface or to the leg and ankle of the wearer. Some of these braces are actually intended primarily as a shin or ankle guard; or stiffening members inserted into interior pockets formed on the inside surface of the portion of the shoe upper covering the ankle or stiffeners in a sock-like brace with straps further binding the shoe upper or brace around the ankle. Conventional braces may also be considered to include the variety of rigid orthopedic clamps worn either separately or with or as part of a specially constructed shoe, rigid foot plate or sole. Furthermore, it is known to incorporate air-inflatable devices or air bags into the conventional ankle supports and related devices.

Accordingly, is an object of the present invention to provide a shoe with an integral ankle support that is adapted to control internal and external rotation of a rear portion of a wearer's foot.

Another object of the present invention is to provide a shoe with an integral ankle support that has a construction intended to impede or prohibit internal and external rotation of the rear portion of the foot about the talofibular and talotibial joint. With the shoe construction of this invention it is desired to limit the indicated rotation in a manner not effectively accomplished by conventional constructions.

A further object of the present invention is to provide a shoe with an integral ankle support internally connected or associated with the shoe for providing support to the ankle and prohibiting as much as possible the talofibular and the talotibial joints from undergoing external and internal rotation.

Still another object of the present invention is to provide a shoe with an integral ankle support that is constructed to provide opposing braces individually attached to the shoe and a lower portion of a heel cup of the shoe. The brace arrangement of this invention provides for free anterior and posterior brace rotating or pivoting.

Still a further object of the present invention is to provide a shoe with a integral ankle support constructed from generally rigid thermoplastic material.

Another object of the present invention is to provide a shoe with an integral ankle support including and ankle brace attachment and adjustment strap system. The shoe of this invention incorporates adjustable straps effectively joining the brace members, including an anterior strap across the ankle. The straps may include and adjustable anterior strap for compressing the brace members and a distal lower portion of the brace members hinged for pivoting movement relative to the shoe. Thus, this invention provides a shoe and brace system combination providing means for limiting eversion and inversion and internal and external rotation of the tibia and fibula while allowing full-range motion in the dorsi and planter flexion plane.

SUMMARY OF THE INVENTION

To accomplish the foregoing and other objects of this invention there is provided a shoe with an integral ankle support for restricting a wearer's talofibular and talotibial joints from external and internal rotation. The shoe comprises means for providing ankle support and inhibiting internal and external rotation of a rearward portion of a foot supported by the shoe. The inhibiting means forms an integral part of the shoe and allows full-range dorsi and planter flexion of the foot. The shoe of this invention further includes means for securing the inhibiting means in generally compressive communication with the ankle joint so as to provide the desired limitation of foot and ankle joint motion. The inhibiting means comprises medial support means and opposing lateral support means for limiting eversion and inversion and internal and external tibia and fibula rotation. The support means is pivotally associated with respective medial and lateral shoe upper portions. The securing means may comprise an adjustable strap system operatively associated with the shoe and inhibiting means that provides an adjustable and compressive influence on the inhibiting means and into abutting relationship with the ankle joint. A shoe incorporating the integral ankle support of this invention further comprises a plurality of adjustable straps members operatively associated with support means and the shoe. A shoe incorporating the integral ankle support as set forth for the present invention includes intermediate brace support means that protect the foot from abrasive contact with brace means, such that the shoe may be worn for relatively extensive periods without abrasion or discomfort. A shoe providing this invention will typically include an upper portion and a sole portion, the upper portion including a vamp portion with a medial side portion and lateral side portion and a heel counter portion, the sole including an outer sole and an inner sole with a heel cup at the shoe posterior for receiving the heel of the wearer.

These and other objects and features of the present invention will be better understood and appreciated from the following detailed description of embodiments thereof, selected for purposes of illustration and shown in the accompanying drawings.

DETAILED DESCRIPTION

Figure 1:
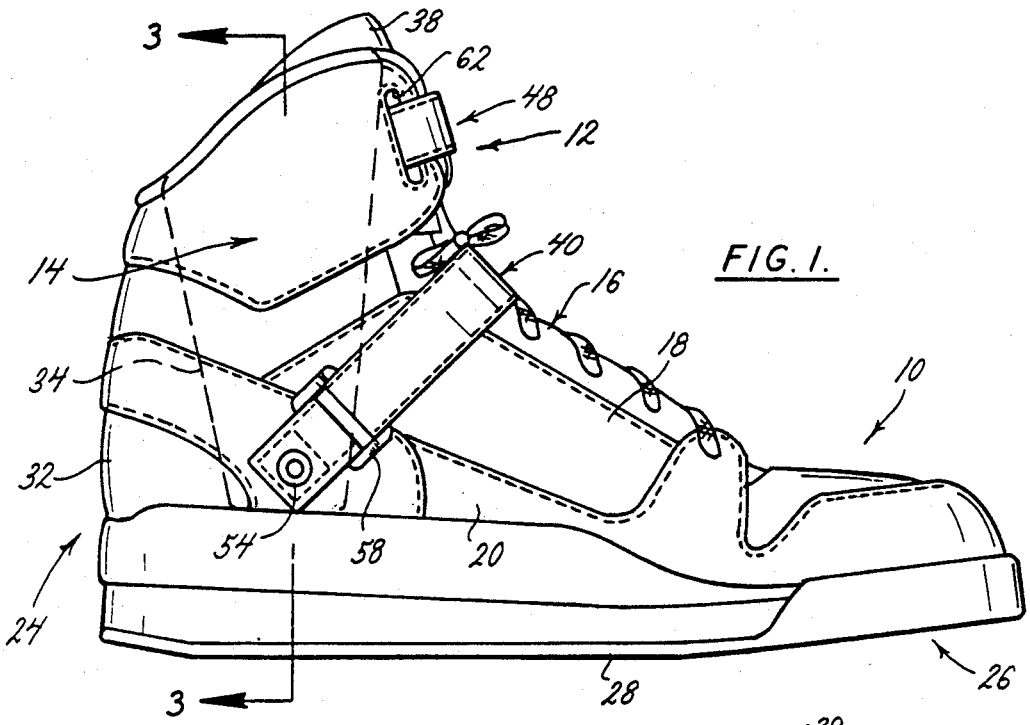
FIG. 1 is a lateral side elevation view of a shoe constructed in accordance with the present invention.
Figure 2:
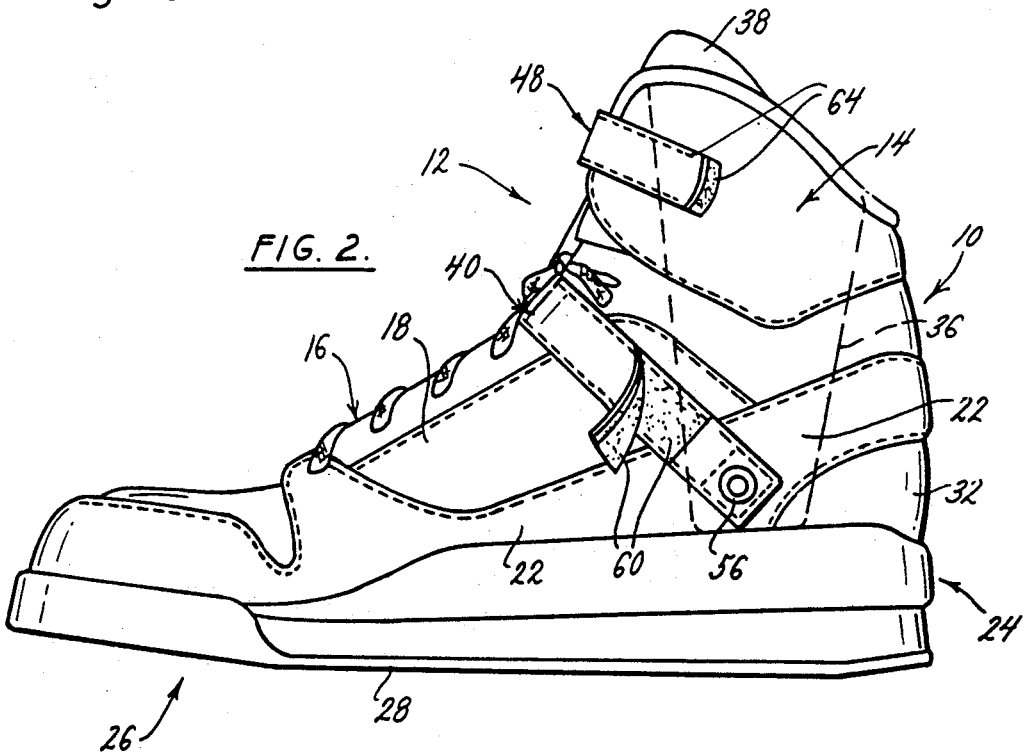
FIG. 2 is a medial side elevation view of the shoe depicted in FIG. 1.
Figure 3:
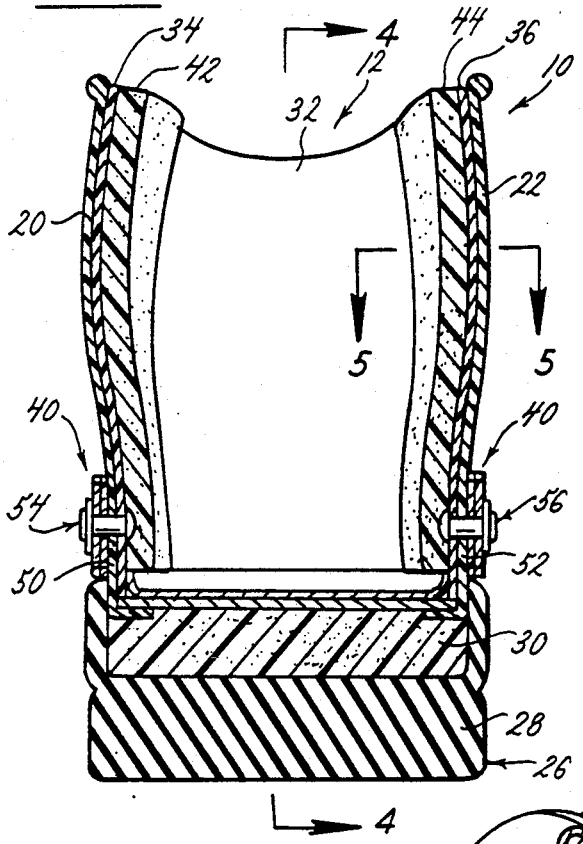
FIG. 3 is a cross-sectional view taken along line 3—3 in FIG. 1.
Figure 6:
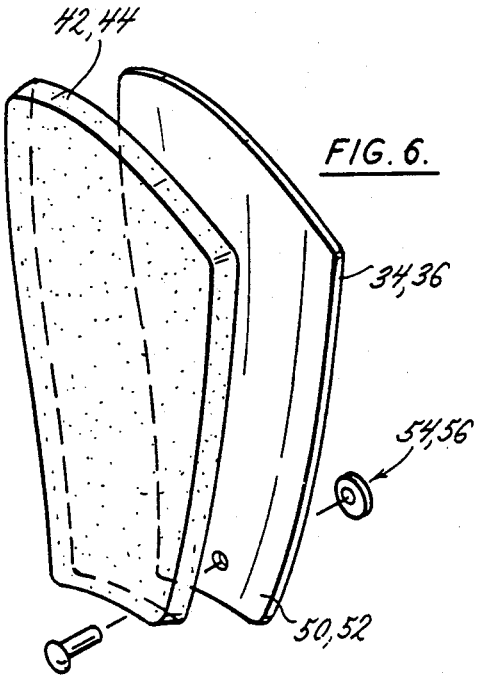
FIG. 6 is an exploded view of a preferred embodiment of the brace and hinge arrangement of this invention.
Figure 4:
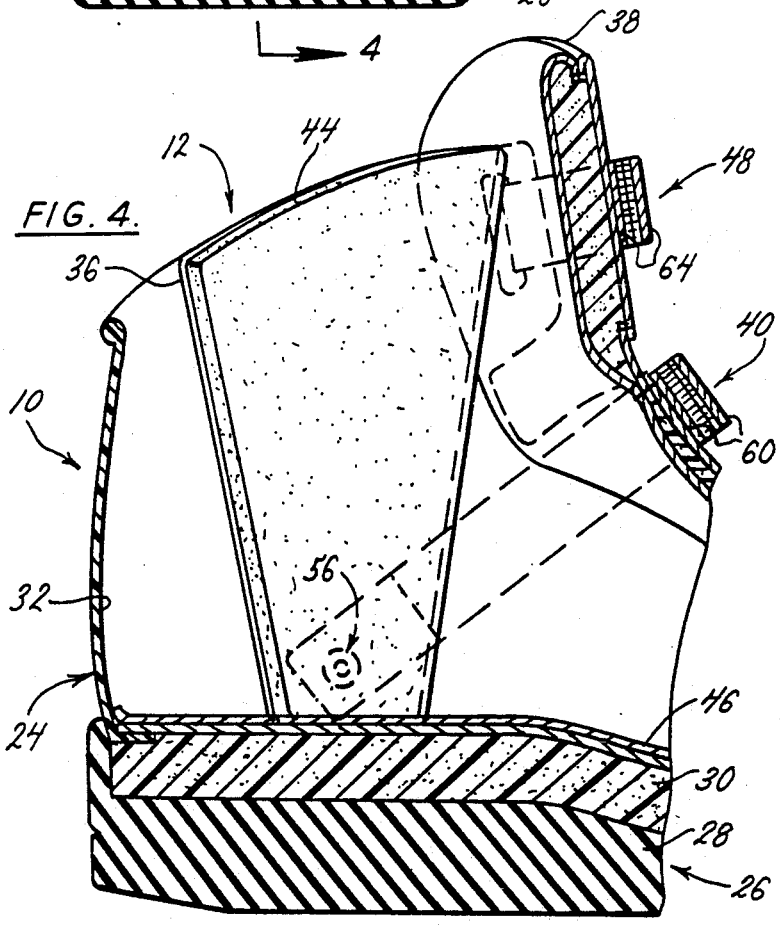
FIG. 4 is a cross-sectional view taken along line 4—4 in FIG. 3.
Figure 5:
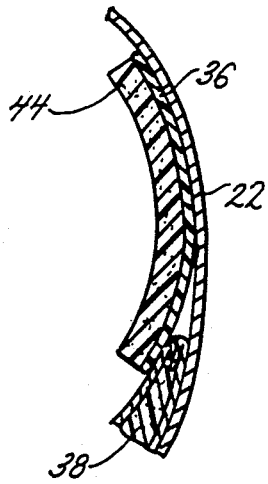
FIG. 5 is a cross-sectional view taken along line 5—5 in FIG. 3.

Referring now to the drawings there is shown a preferred embodiment for the shoe with an integral ankle brace of this invention. The shoe is described in connection with an athletic shoe typically known as a "hightop" model. The shoe and brace construction of the present invention is particularly adapted for providing increased ankle support and substantially inhibiting internal and external rotation of the talofibular and talotibial joints. The ankle is supported and protected from sprain and tearing of the ligaments about the ankle joint.

The drawings show an athleteic shoe 10 and an associated and internally attached ankle brace system 12. The ankle brace system includes an ankle brace attachment and adjustment strap system 14. The athletic shoe 10 includes a shoe upper 16 and a vamp portion 18. Further constructions of the athletic shoe include a medial side portion 20, an opposing lateral side portion 22, and a heel counter portion 24. The athletic shoe 10 also includes a combination sole 26 with its outer sole 28 and inner sole 30. A heel cup 32 is located at the rearward portion of the shoe.

The internally attached ankle brace system 12 and ankle brace attachment and adjustment strap system 14 consists of a plurality of brace means for substantially inhibiting a wearer's talofibular and talotibial joints from external and internal rotation. The brace combination includes a medial brace member 34 and a lateral brace member 36. The brace combination becomes an integral part of the high-top athletic shoe 10 in part through the ankle brace attachment and adjustment strap system 14. A conventional tongue and lacing system are adequate for the present invention. It will be understood that straps may be substituted for the laces, or a combination of straps and laces. The brace members 34 and 36 may be a thermoplastic material.

The brace members are operatively attached to the shoe 10 with suitable hinge means for providing anterior and posterior brace member movement. Adjustable strap means provide for adjustable positioning of the brace members about the ankle of the wearer. Hinge means operatively associated with the braces and the shoe provide for further brace adjustment in concert with the strap means. A liner means provides a cushion and protective layer between the inner surface and the rigid brace members and the foot of the wearer. Each brace member is padded for the wearer's comfort and to increase the adjustability of any associated strap means. Strap means are located and operatively associated with the upper portion of the respective brace members. The medial and lateral brace members are further adjustable by means of another strap means operatively associated with the brace members and adjustable across the ankle joint dorsum. It will now be understood that as described herein and as set forth in further detail below, that the brace and strap configuaration of this invention provides for normal anterior and posterior ankle joint motion, or planter and dorsal ankle joint motion or flexion while restricting or inhibiting ankle joint internal and external rotation.

The illustrated embodiment shows the brace members 34 and 36 attached by pin or hinge members to the shoe in order to provide an integration of shoe and brace system. The brace may be a semi-rigid thermoplastic material. The braces may be padded for a more comfortable fit and extended wear, especially, active wear of the shoe. Typically, the present invention includes padding means for both the medial and lateral brace. Both the medial brace padding 42 and lateral brace padding 44 may be a neoprene rubber material.

A shoe of the present invention typically includes a relatively soft inner sole inner lining or sock liner 46. As illustrated in the drawings, a standard or conventional tongue and an associated lacing system 38 provides for closure of the opposing medial and lateral side portions of the shoe's vamp portion.

The present invention further includes an adjustable anterior strap 40 as part of the attachment and adjustment strap system 14 provided for the purpose of tightening or cinching the shoe 10 and ankle brace system 12 down and over the mortuus of the ankle joint. The strap 40 angles generally downward as illustrated and is preferably attached to the medial and lateral side portions of the shoe at the pivot point for the brace means.

Another adjustment means provides for adjustable compression of the medial and lateral brace members 34, 36 closely against the bone arrangement defining the ankle joint. In a preferred embodiment an upper adjustable strap 48 located at the top of the shoe connects the medial and lateral sides 20, 22 of the shoe 10. Strap 48 is preferably sewn directly to or otherwise operatively attached to the medial and lateral braces 34, 36. It will be understood that the function of strap 48 may be accomplished by lacing arrangements or a combination of a lacing and strap arrangement.

The medial and lateral brace members 34 and 36 are integrated into the structure of the shoe 10. The medial brace member 34 and the lateral brace member 36 are operatively connected to the shoe 10 by hinge means for allowing the anterior and posterior ankle joint movement (the plantar and dorsal flexion referred to previously) while the brace members are compressively held against the ankle joint by the adjustable strap assembly. The medial and lateral brace members include distal portions 50, 52 and associated medial hinge means and lateral hinge means. A medial hinge member 54 may include a rivet or similar pin member connected to the medial side portion 20 of the shoe 10. A lateral hinge member 56 may include another rivet or similar pin member connected to the lateral side portion 22 of the shoe 10.

In a preferred embodiment the anterior strap 40 is positioned at an angle of approximately forty degrees (40°) above a horizontal plane. The strap member 40 is held against the outer lateral side portion 20 of the shoe 10 by the head of the lateral rivet 56. The strap member 40 includes a ring member 58 of plastic, metal, or other sutiable material. The ring member 58 receives the strap member 40 which is then folded back over itself and adjustable and secured by suitable fastening means. In a preferred embodiment the fastening means is provided by a hook and loop fastening arrangement 60, such as, conventional VELCRO brand hook and loop fasteners. It is not necessary to describe in a greater detail the particular arrangement or attachment of the hook and loop fastener to the strap members. It will be further understood that other suitable fastening means such as buckle or two long strap members will perform similar adjustable, compressive securement of the strap or straps and therefore the brace members about the ankle joint.

In a preferred embodiment of a shoe incorporating the support and binding system 14 the upper adjustable strap member 48 provides adjustable closure means for medial and lateral upper portions and medial and lateral brace members. As illustrated, the strap member 62 is advanced through a slot 62 and back over itself where another VELCRO brand hook and loop fastener 64 or its equivalent provides means for adjustable securing of the strap 48. In another embodiment of the present invention the upper anterior strap combination is provided in lieu of conventional laces. The strap 48 is typically secured to the upper lateral portion of the shoe 10 by stitching, rivets, or other suitable fastening or attachment devices.

It will be understood that the strap arrangements may be reversed with the ring or slot provided on the medial side of the shoe upper instead of the lateral side.

In the foregoing embodiments or any of their equivalents, the upper adjustable strap 48 or laces (not shown) provide for more complete and continuous compression of the brace members 34 and 36 generally uniformly against the ankle joint of the wearer.

Referring to the preferred embodiment illustrated and described herein, it will be understood that inner compressive means, for example brace padding 42, 44 provide for compression of the bones of the ankle joint.

Knowledge of the bone structure of the foot, ankle, and leg is presumed and only a brief discussion of the ankle joint structure is included in the present description. The ankle joint is composed of three bones, including tibia, fibula, and talus. The ankle joint further includes the articulation, hinged or jointed connection and movement of these bones with the calcaneus and additional tarsal bones. The fibula includes a distal portion forming a lateral prominence of the ankle, typically known as a medial malleolus and are joined by a syndesmosis. The distal ends of the tibia and fibula join and form a mortuus at the juncture. Held inside the mortuus, the talus provides the ankle joint with its hinge-like qualities. A series of ligaments provide joint stability.

Anatomical stability of an unsupported or braced ankle joint is provided by connection of the anterior portion of the lateral malleolus to the talus by the anterior talofibular ligament. The calcaneal fibular ligament connects the fibula to the calcaneus. The posterior talofibular ligament connects the posterior portion of the fibula to the talus. The deltoid ligament connects the tibia to the talus from an anterior, medial, and posterior perspective, thereby providing a desired ankle joint medial stability.

As previously mentioned, the sprain is the most common ankle injury. Simply defined, an ankle sprain occurs when an ankle is forced past its normal range of motion in any one of three planes. Joint motion out of the normal range typically causes tearing or separation of ligament fibers of potentially any one of the aforementioned ligaments surrounding the ankle joint. Conventional belief would have an ankle joint sprain occur upon vigourous inversion or eversion of the joint. The present invention is constructed to inhibit ankle joint sprain upon the occurrence of a more complex motion which is believed to cause the sprain.

The present invention is particularly suited to inhibit ankle sprain caused by inversion and eversion coupled with either an external or an internal rotation of the tibia and the fibula, and motion of the talus inside the mortuus. It is believed that the most common ligament related injuries related to the ankle joint involve the anterior talofibular, the calcanea-fibular, and the posterior talofibular ligaments. It is believed that these ligament injuries occur upon internal tibia and fibula rotation while the foot is inverted.

In operation, in connection with the high-top athletic shoe 10 previously mentioned, a support means is provided to protect the ankle joint from a sprain or related ankle injury. The combination of the brace members and operatively associated strap members provide primarily medial and lateral compressive forces to prohibit or at least inhibit and otherwise help prevent eversion and inversion as well as internal and external rotation of the tibia and fibula while allowing normal dorsi and planter flexion of the wearer's foot.

The wearer's foot is placed into the shoe in the normal manner. In a preferred embodiment, the wearer's foot slips into the shoe and between the padded brace members. The brace padding protects the foot from direct contact with the brace members, which could be a semi-rigid plastic material. The straps 40 and 48 are cinched so as to firmly press the braces about the ankle. The foot is now compressed intermediate the brace members and associated padding within the shoe.

The wearer's foot is now compressed and held within the shoe with ankle joint intermediate the medial and lateral brace members. The hinged portion of the brace members allow the wearer movement or flex of the ankle joints in the anterior and posterior direction (the dorsi and the planter flexion plane) and the adjustable straps and brace arrangement inhibit or limit eversion and inversion and internal and external rotation of the tibia and fibula to reduce the possibility of an ankle sprain.

The shoe of the present provides the desired ankle support without detracting from the overall aesthetics of the shoe. The brace members in some preferred embodiments may slightly extend above the top of the shoe.

While specific embodiments have been shown and described, many variations are possible. The present invention pertains and relates to a shoe and particularly an activity or athletic shoe that may be used in practically any type of athletic competition, for example, football, baseball, basketball, and a variety of other court sports. It will be further understood that this invention may be designed for use with boots, such as hiking boots, camping boots, or work boots (as well as work shoes). Typically, an athletic shoe incorporating this invention is constructed from a polyurethane sole and a fabric or leather upper joined together in a conventional manner. VELCRO brand hook and loop fasteners may be replaced with any suitable, equivalent fastening means. The straps are preferably a nylon webbing.

Having described the invention in detail, those skilled in the art will appreciate that modifications may be made of the invention without departing from its spirit. Therefore, it is not intended that the scope of the invention be limited to the specific embodiments illustrated and described. Rather, it is intended that the scope of this invention be determined by the appended claims and their equivalents.

What is claimed is:

1. A shoe for providing ankle support, comprising:

means for inhibiting internal and external rotation of a rearward portion of a foot supported by the shoe, the inhibiting means comprising a plurality of generally opposed members, the inhibiting means attached to the shoe as a substantially integral part of the shoe, the inhibiting means attached to the shoe for movement generally independent of the shoe and for movement generally dependent upon motion of the foot, whereby the inhibiting means allows full-range dorsi and planter flexion of the foot; and means for securing the inhibiting means in compressive coummunication with the ankle joint, the securing means securing the inhibiting means below an axis of rotation defined by the dorsi and the plantar flexion of the foot, the securing means limiting motion of a rearward portion of the foot.

2. A shoe as set forth in claim 1 wherein the inhibiting means compises medial support means and opposing lateral support means for limiting eversion and inversion and internal and external tibia and fibula rotation.

3. A shoe as set forth in claim 2 wherein the support means is pivotally associated with its respective medial and lateral shoe upper portions.

4. A shoe as set forth in claim 1 wherein the securing means comprises and adjustable strap system operatively associated with the shoe and the inhibiting means for adjustably, copressively influencing the inhibiting means in abutting relationship with the ankle joint.

5. A shoe with integral ankle support, comprising:

means for providing integral ankle brace support for a wearer of the shoe, the ankle brace support means comprising a plurality of separated, generally opposed and independent brace support means, the ankle brace support means attached to the shoe as a substantially integral part of the shoe, the ankle brace support means attached to the shoe for movement generally independent of the shoe and for movement generally dependent upon motion of the foot;

means for adjustably urging the ankle brace support means into compressive contact with the ankle of the wearer, the adjusting means including a strap assembly associated with the shoe and the ankle brace support means, the strap assembly located below an axis of rotation defined by the dorsi and the planter flexion of the foot, the strap assembly limiting motion of a rearward portion of the foot; and hinge means operatively associated with brace means, the adjustment means, the strap assembly, and the shoe for providing pivotal brace means motion, thereby limiting ankle joint motion and eversion and inversion and internal and external tibia and fibula rotation while allowing full-range dorsi and planter flexion of the foot within the shoe.

6. A shoe with integral ankle support as set forth in claim 5 wherein the brace means further comprise medial brace means and opposing lateral brace means.

7. A shoe with integral ankle support as set forth in claim 5 wherein the adjustment means further comprise a plurality of adjustable straps members operatively associated with the brace support means and the shoe.

8. A shoe with integral ankle support as set forth in claim 5 including intermediate brace support means for protecting the foot from abrasive contact with the brace means, whereby the shoe may be worn for relatively extensive periods without abrasion or discomfort.

9. A shoe with integral ankle support as set forth in claim 8 including means for providing adjustable contact between the brace support means, the intermediate means and the foot.

10. A shoe as set forth in claim 1 wherein the securing means comprises a strap extending between the inhibiting means and below the axis of dorsi and plantar flexion of the foot, the strap limiting the motion of the rearward portion of the foot.

11. A shoe having an upper portion and a sole portion, the upper portion including a vamp portion with a medial side portion and lateral side portion and a heel counter portion, the sole including an outer sole and an inner sole with a heel cup at the shoe posterior for receiving the heel of the wearer, comprising:

a lateral brace member and an associated lateral hinge means for attaching the lateral brace member to the shoe lateral side portion;

a medial brace member and an associated medial hinge means for attaching the medial brace member to the shoe medial side portion, the lateral brace member and the medial brace member acting upon the foot of the wearer from generally opposite sides of the foot and the generally opposed lateral and medial brace members separated and generally independent one from the other;

anterior adjustment means extending from the shoe lateral side portion to the shoe medial side portion for adjustably compressing the lateral and medial brace members into supporting relationship with the ankle joint, the anterior adjustment means located below an axis of rotation defined by the dorsi and plantar flexion of the foot; and upper anterior adjustment means for adjustably compressing the lateral and the medial brace members into supporting relationship with the ankle joint, whereby the combination of the brace and adjustment members limit motion of a rearward portion of the foot, provide increased ankle support and substantially inhibit internal and external rotation of the talofibular and talotibial joints while the ankle is supported and protected from sprain and tearing of the ligaments about the ankle joint.

12. A shoe as set forth in claim 11 wherein the lateral and medial hinge means comprise a pair of opposing rivet members attached to their respective side portions of the shoe and pivotally affixing their respective brace members to the shoe.

13. A shoe as set forth in claim 12 wherein the rivets are located in distal end portions of the lateral and medial brace members.

14. A shoe as set forth in claim 11 wherein padding means attached to the lateral brace member and the medial brace member increase the comfort of wearing and using the shoe.

15. A shoe as set forth in claim 11 including inner compressive means intermediate the lateral brace member and the medial brace member for providing further compression of the brace members.

16. A shoe as set forth in claim 11 wherein a brace member comprises a semi-rigid thermoplastic.

17. A shoe as set forth in claim 11 wherein the upper anterior adjustment means comprise an adjustable strap assembly.

18. A shoe as set forth in claim 11 wherein the anterior adjustment means comprise an adjustable strap assembly.

* * * * *